US010384327B2

(12) United States Patent
Bitzel, Jr. et al.

(10) Patent No.: US 10,384,327 B2
(45) Date of Patent: Aug. 20, 2019

(54) BLADE FOR CENTRIFUGAL BLAST WHEEL MACHINE AND METHOD OF MAINTAINING A CENTRIFUGAL BLAST WHEEL MACHINE

(71) Applicants: Wheelabrator Group Limited, Cheshire (GB); Raymond Paul Bitzel, Jr., Newnan, GA (US); Michael Dwayne Reaves, Pine Mountain, GA (US); Christoph Baer, Bassersdorf (CH); Philipp Weissenberger, Klettgau-Erzingen (DE); Jürgen Wruck

(72) Inventors: Raymond Paul Bitzel, Jr., Newnan, GA (US); Michael Dwayne Reaves, Pine Mountain, GA (US); Christoph Baer, Bassersdorf (CH); Philipp Weissenberger, Klettgau-Erzingen (DE); Jürgen Wruck, Wesseling (DE)

(73) Assignee: Wheelabrator Group Limited, Cheshire (GB)

( * ) Notice: Subject to any disclaimer, the term of this patent is extended or adjusted under 35 U.S.C. 154(b) by 246 days.

(21) Appl. No.: 15/513,878

(22) PCT Filed: Sep. 25, 2014

(86) PCT No.: PCT/US2014/057367
§ 371 (c)(1),
(2) Date: Mar. 23, 2017

(87) PCT Pub. No.: WO2016/048319
PCT Pub. Date: Mar. 31, 2016

(65) Prior Publication Data
US 2017/0304994 A1 Oct. 26, 2017

(51) Int. Cl.
*B24C 5/06* (2006.01)

(52) U.S. Cl.
CPC ..... *B24C 5/06* (2013.01); *B24C 5/062* (2013.01)

(58) Field of Classification Search
CPC ..... B24C 5/06; B24C 5/062
(Continued)

(56) References Cited

U.S. PATENT DOCUMENTS 1,996,885 A * 4/1935 Schemmann ..... B24C 5/06 451/97
2,204,633 A 6/1940 Turnbull
(Continued)

FOREIGN PATENT DOCUMENTS

CN 1166149 A 11/1997
CN 1451517 A 10/2003
(Continued)

OTHER PUBLICATIONS

Notification of Transmittal of the International Search Report and the Written Opinion of the International Searching Authority from corresponding PCT/US2014/057367 dated Dec. 24, 2014.
(Continued)

*Primary Examiner* — George B Nguyen
(74) *Attorney, Agent, or Firm* — Lando & Anastasi, LLP

(57) ABSTRACT

A centrifugal blast wheel machine comprises a housing and a wheel assembly coupled to the housing. The wheel assembly has a plurality of blades configured to throw blast media introduced into the wheel assembly against a work piece. According to one embodiment, each blade of the plurality of blades includes a curved portion positioned adjacent a central hub of the wheel assembly, and a straight portion integrally formed with the curved portion extending radially outwardly from the wheel assembly. According to another embodiment, each blade includes a first side rail extending
(Continued)

along the blade, the first side rail having a first recess, and a first grommet positioned in the first recess.

14 Claims, 9 Drawing Sheets

(58) Field of Classification Search
USPC ..... 451/97
See application file for complete search history.

(56) References Cited

U.S. PATENT DOCUMENTS

| | | | | | |
|---|---|---|---|---|---|
| 2,368,664 | A | * | 2/1945 | Keefer | B24C 5/06 451/343 |
| 2,590,576 | A | | 3/1952 | Rosenberger et al. | |
| 3,241,266 | A | * | 3/1966 | Bowling, Jr. | B24C 5/062 451/97 |
| 3,242,615 | A | * | 3/1966 | Physioc, III | B24C 5/06 451/97 |
| 3,287,858 | A | * | 11/1966 | Moore | B24C 5/062 451/97 |
| 3,348,339 | A | * | 10/1967 | Bowling, Jr. | B24C 5/062 451/97 |
| 3,352,064 | A | * | 11/1967 | De Groot | B24C 5/062 451/97 |
| 3,401,489 | A | * | 9/1968 | Wern | B24C 5/064 451/97 |
| 3,678,629 | A | | 7/1972 | Leliaert | |
| 3,785,105 | A | | 1/1974 | Freeman | |
| 3,872,624 | A | | 3/1975 | Ramaswamy | |
| 4,207,712 | A | | 6/1980 | Toedtli | |
| 4,249,350 | A | * | 2/1981 | Goff | B24C 5/062 451/97 |
| 4,395,851 | A | * | 8/1983 | Watts | B24C 5/06 451/97 |
| 5,769,693 | A | | 6/1998 | Wadephul | |
| 6,764,390 | B2 | | 7/2004 | Holloway et al. | |

FOREIGN PATENT DOCUMENTS

| | | | | | |
|---|---|---|---|---|---|
| EP | 0001969 | A1 | | 5/1979 | |
| EP | 1352713 | A1 | * | 10/2003 | B24C 5/062 |
| EP | 1398113 | A1 | | 3/2004 | |
| EP | 1930122 | A1 | | 6/2008 | |
| EP | 2826593 | A1 | | 1/2015 | |
| FR | 2252174 | A1 | | 6/1975 | |
| GB | 1003441 | A | | 9/1965 | |
| GB | 1328417 | A | | 8/1973 | |
| GB | 2152411 | A | | 8/1985 | |
| WO | 0228594 | A1 | | 4/2002 | |

OTHER PUBLICATIONS

Extended European Search Report from corresponding European Application No. 14902531.4 dated Aug. 1, 2018.
Partial Supplementary European Search Report from corresponding European Application 14902531.4 dated Mar. 22, 2018.
Chinese Search Report from corresponding Chinese Application No. 2014800821406 dated May 28, 2018.

* cited by examiner

BLADE FOR CENTRIFUGAL BLAST WHEEL MACHINE AND METHOD OF MAINTAINING A CENTRIFUGAL BLAST WHEEL MACHINE

CROSS-REFERENCE TO RELATED APPLICATIONS

This application is a U.S. National Stage Application under 35 U.S.C. § 371 of International Application No. PCT/US2014/057367, filed Sep. 25, 2014, titled BLADE FOR CENTRIFUGAL BLAST WHEEL MACHINE AND METHOD OF MAINTAINING A CENTRIFUGAL BLAST WHEEL MACHINE, which is hereby incorporated herein by reference in its entirety.

BACKGROUND OF THE DISCLOSURE

1. Field of the Disclosure

The present disclosure relates generally to centrifugal blast wheel machines, and more particularly to blades for a centrifugal blast wheel machine and to methods of maintaining a centrifugal blast wheel machine.

2. Discussion of Related Art

Centrifugal blast wheel machines generally include a rotatable hub to which is mounted a disk or a pair of spaced disks which carry radially extending blades. Particulate matter is discharged from a center of the wheel disk onto rotating surfaces of the blades, which propel the particulate matter against surfaces of a work piece to be cleaned or treated. Specifically, blast media is fed from a feed spout into a rotating impeller situated within a control cage at the center of the blast wheel. The media is fed from the impeller, through an opening in a control cage and onto leading edges of the rotating blades. The media travels along top surfaces of the blades and is thrown from trailing edges of the blades at the work piece surfaces to be treated.

Operating and properly maintaining a blast wheel can incur multiple ongoing expenses. For example, a cost associated with supplying blast media is one such expense. Another example is a cost associated with maintaining the blast wheel by replacing blades that have become worn down.

SUMMARY OF THE DISCLOSURE

One embodiment of the disclosure is directed to a centrifugal blast wheel machine comprising a housing and a wheel assembly coupled to the housing. The wheel assembly has a plurality of blades configured to throw blast media introduced into the wheel assembly against a work piece. Each blade of the plurality of blades includes a curved portion positioned adjacent a central hub of the wheel assembly, and a straight portion integrally formed with the curved portion extending radially outwardly from the wheel assembly.

According to certain embodiments of the centrifugal blast wheel machine, each blade of the plurality of blades may have a first edge proximate the curved portion, and a second edge proximate the straight portion. According to certain embodiments of the centrifugal blast wheel machine, the first edge and the second edge may form an angle of between 105° and 145°. According to certain embodiments of the centrifugal blast wheel machine, the first edge and the second edge may form an angle of between 120° and 130°. According to certain embodiments of the centrifugal blast wheel machine, the curved portion may extend approximately one half a length of each blade.

Another aspect of the present disclosure is directed to a centrifugal blast wheel machine comprising a housing, and a wheel assembly coupled to the housing. The wheel assembly includes a first wheel disk with a first side and a first plurality of grooves in the first side and a plurality of blades configured to throw blast media introduced into the wheel assembly against a work piece. Each blade includes a first side rail extending along the blade, the first side rail having a first recess, and a first grommet positioned in the first recess. Each groove is configured to receive a corresponding blade of the plurality of blades. The corresponding blade is secured in place through a compression fit between the first side of the first wheel disk and the first grommet of the corresponding blade.

According to certain embodiments of the centrifugal blast wheel machine, the first side rail may be tapered to aid in creating the compression fit. According to certain embodiments of the centrifugal blast wheel machine, each of the blades further may comprise a second side rail extending along the blade, the second side rail being opposite the first side rail. According to certain embodiments of the centrifugal blast wheel machine, the second side rail may comprise a second recess and a second grommet positioned in the second recess. According to certain embodiments of the centrifugal blast wheel machine, the wheel assembly further may include a second wheel disk having a second side and a second plurality of grooves in the second side, the second side of the second wheel disk being spaced apart from the first side of the first wheel disk.

According to certain embodiments of the centrifugal blast wheel machine, each groove of the first plurality of grooves and each groove of the second plurality of grooves may be configured to receive a corresponding blade from the plurality of blades, the corresponding blade being secured in place through compression fit between the first side of the first wheel disk and the first grommet of the corresponding blade and between the second side of the second wheel disk and the second grommet of the corresponding blade. According to certain embodiments of the centrifugal blast wheel machine, each of the first side rail and the second side rail may be tapered to aid in forming the compression fit. According to certain embodiments of the centrifugal blast wheel machine, the first grommet and the first recess may be configured to allow removal of the first grommet from the first recess at an end of a service life of the blade. According to certain embodiments of the centrifugal blast wheel machine, each of the first grommet and the first recess may be rounded.

According to certain embodiments of the centrifugal blast wheel machine, each blade further may include a curved portion positioned adjacent a central hub of the wheel assembly and a straight portion integrally formed with the curved portion extending radially outwardly from the wheel assembly. According to certain embodiments of the centrifugal blast wheel machine, each blade of the plurality of blades may have a first edge proximate the curved portion, and a second edge proximate the straight portion. According to certain embodiments of the centrifugal blast wheel machine, the curved portion may extend approximately one half a length of each blade.

Yet another aspect of the present disclosure is directed to a method of maintaining a centrifugal blast wheel machine. In one embodiment, the method comprises: providing a centrifugal blast wheel machine having a wheel assembly, the wheel assembly including a wheel disk with a groove, and a first blade having a first side rail extending along the first blade, the first side rail having a first recess, and a first grommet positioned in the first recess, the first blade being secured in the groove by a compression fit between the first grommet and the wheel disk; inserting a second blade into the groove of the wheel disk, the second blade having a second side rail extending along the second blade, the second side rail having a second recess, and a second grommet positioned in the second recess; and securing the second blade in the groove by compression fit between the second grommet and the wheel disk.

According to certain embodiments of the method, removing the first blade from the wheel disk may comprise applying a force to the first blade sufficient to overcome the compression fit between the first grommet and the wheel disk. According to certain embodiments of the method, the method further may comprise removing the first grommet from the first blade after removing the first blade from the wheel disk.

BRIEF DESCRIPTION OF THE DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings.

DETAILED DESCRIPTION

Figure 1A:
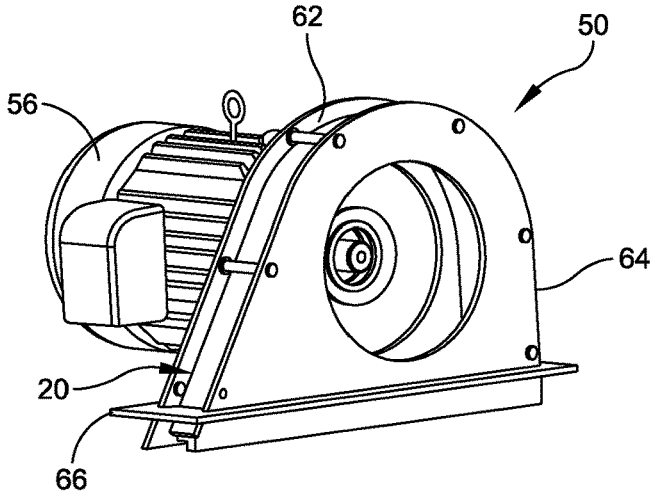
FIG. 1A is a perspective view of a portion of a centrifugal blast wheel machine.

For the purposes of illustration only, and not to limit the generality, the present disclosure will now be described in detail with reference to the accompanying figures. This disclosure is not limited in its application to the details of construction and the arrangement of components set forth in the following description or illustrated in the drawings. The principles set forth in this disclosure are capable of other embodiments and of being practiced or carried out in various ways. Also the phraseology and terminology used herein is for the purpose of description and should not be regarded as limiting. The use of "including," "comprising," "having," "containing," "involving," and variations thereof herein, is meant to encompass the items listed thereafter and equivalents thereof as well as additional items.

The present disclosure is directed blades for a centrifugal blast wheel machine. Specifically, the present disclosure is directed to blades designed to facilitate safer and easier replacement of the blade within the blast wheel and to blades designed to lower abrasive consumption. The present disclosure describes a blade insert to hold the blade during installation and a semi-curved blade for abrasive reduction.

Figure 1B:
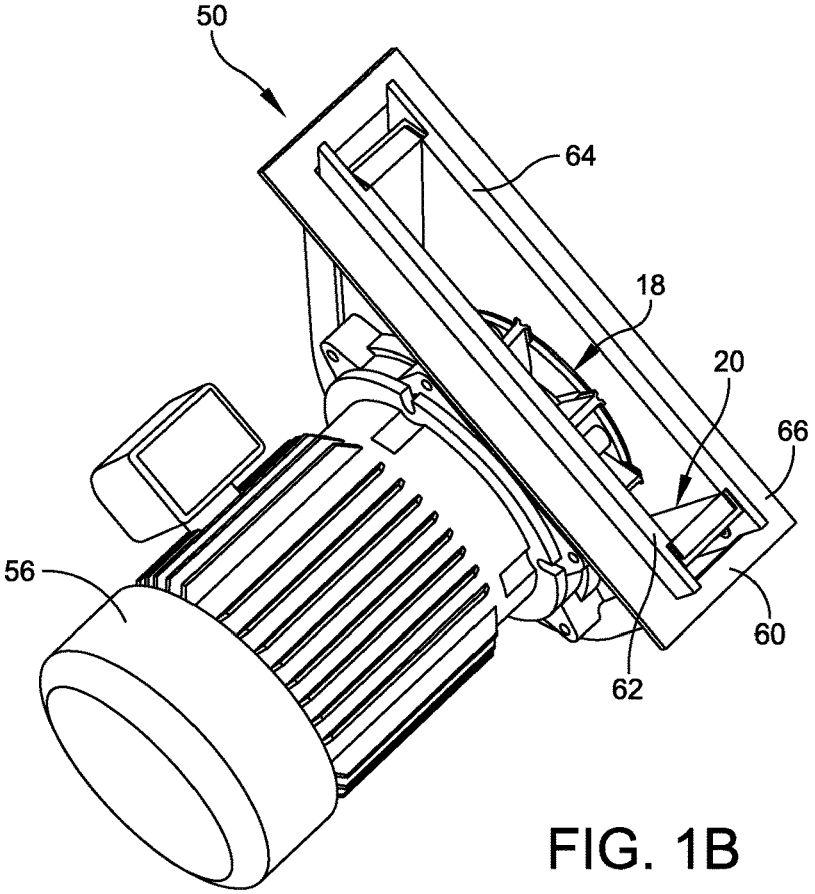
FIG. 1B is another perspective view of a portion of a centrifugal blast wheel machine.
Figure 2:
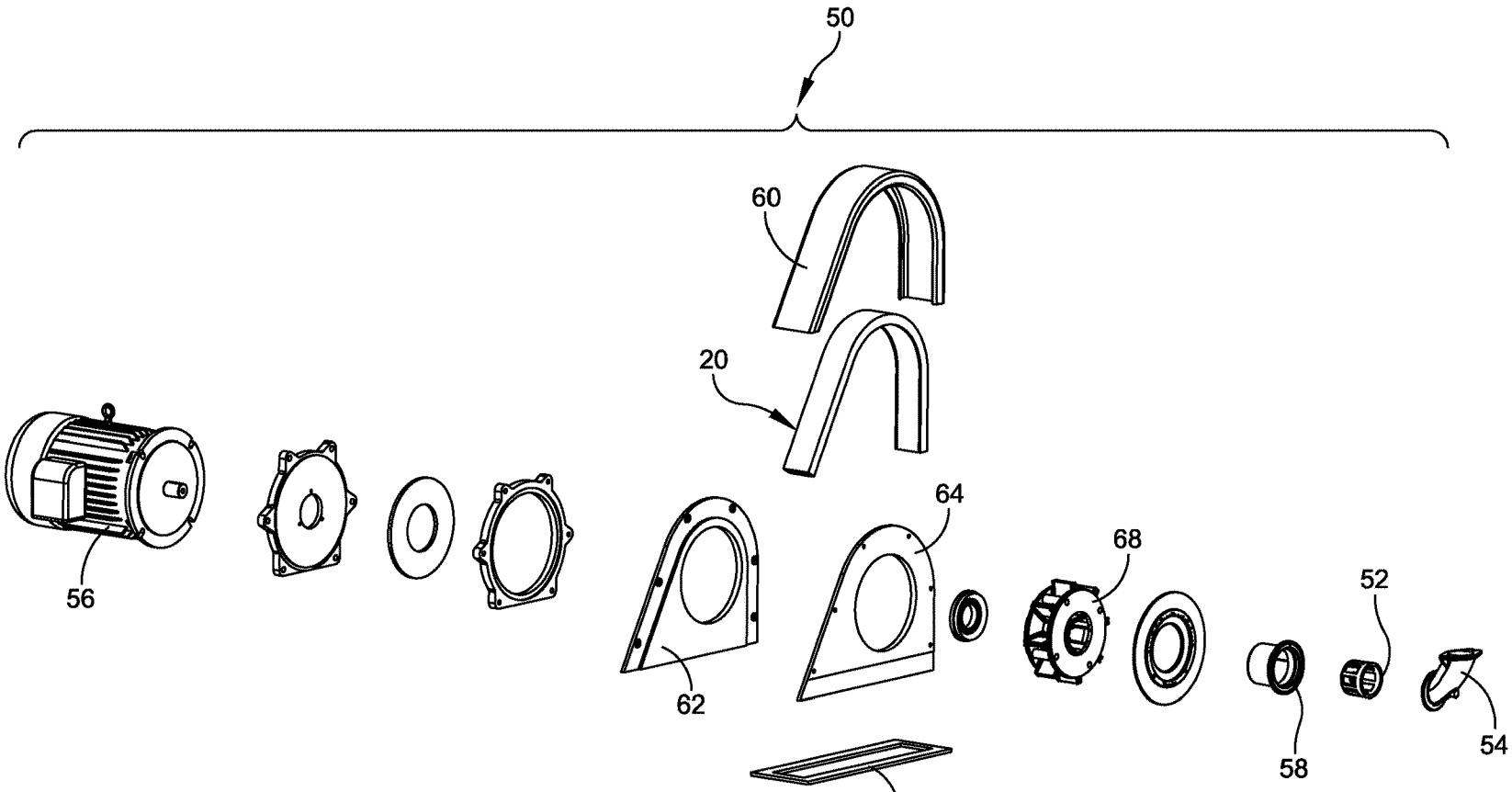
FIG. 2 is an exploded perspective view of a centrifugal blast wheel machine.

Referring to the drawings, the operation of a centrifugal blast wheel machine, generally indicated at 50, can be understood by reference to FIGS. 1A, 1B, and 2. As shown, blast media is fed from a feed spout 54 into a rotating impeller 52, which is driven by a motor 56. By contact with the rotating impeller blades (as well as with other particles of media already in the impeller 52), blast media particles are accelerated, giving rise to a centrifugal force that moves the particles in radial direction, away from the axis of the impeller 52. The particles, now moving in a generally circular direction as well as outwards, move through impeller openings into a space between the impeller 52 and a control cage 58, still being carried by the movement of the impeller blades and the other particles.

When the particles have passed though the impeller openings, rotational and centrifugal forces move the particles onto edges of the blades. The control cage 58 functions to meter a consistent and appropriate amount of blast media onto the blades. As the blades rotate, the particles are moved along their lengths and accelerate until they reach the edges of the blades and are thrown from the edges of the blades.

A lid 60 of the centrifugal blast wheel machine 50 may be provided. As shown, the housing walls 62, 64 are mounted on a mounting flange 66, with the left housing wall 62 being spaced from the right housing wall 64. The lid 60 may have a liner 20.

A wheel assembly generally indicated at 68 having a plurality of blades is further provided to throw blast media introduced into the wheel assembly to treat the work piece. The arrangement is such that the impeller 52 is positioned about an axis of the wheel assembly 68, with the impeller 52 having a media inlet at one end adapted to receive blast media and a plurality of impeller media outlets constructed and arranged to allow egress of blast media upon rotation of the impeller 52. The control cage 58 surrounds the impeller 52 and has a cage media outlet adapted for passage of blast media to the leading edges of the blades. As mentioned above, the motor 56 is coupled to the impeller 52 to drive the rotation of the impeller 52 and the wheel assembly 68.

Figure 3:
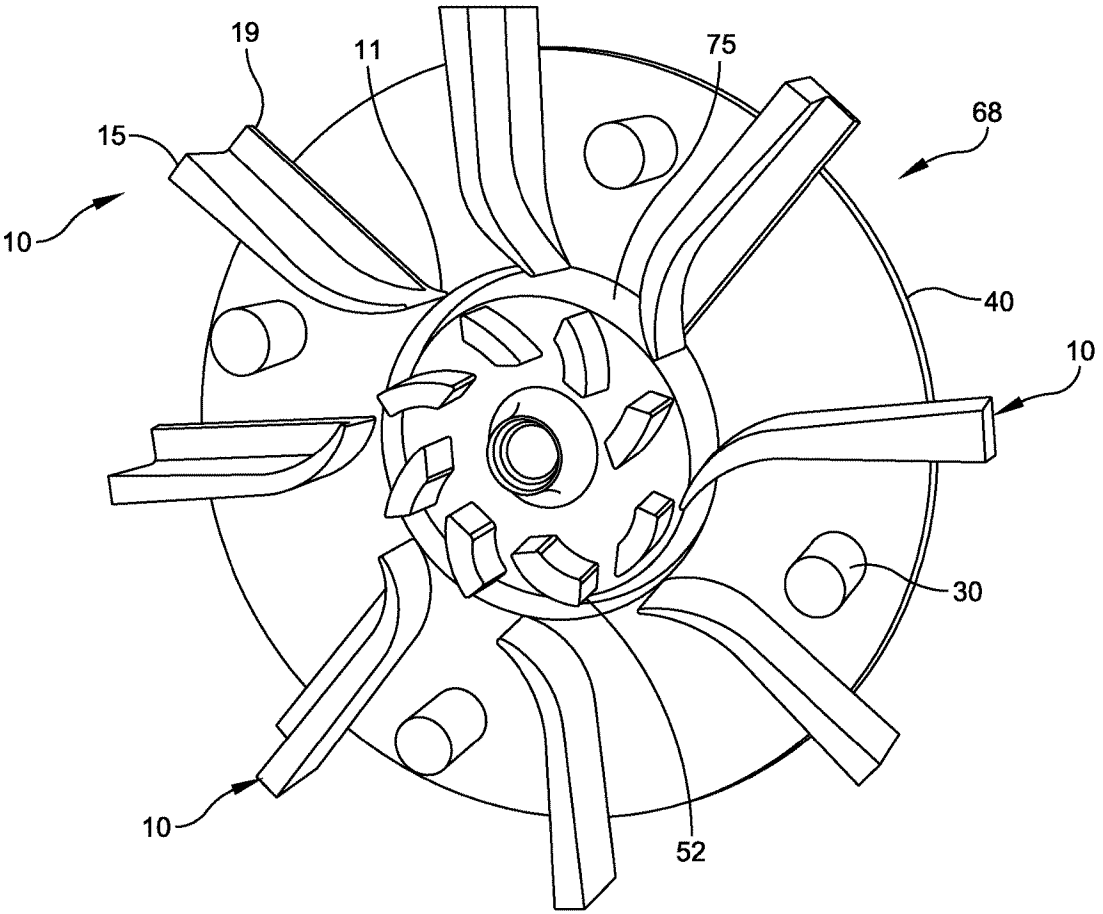
FIG. 3 is a perspective view of a wheel assembly of the centrifugal blast wheel machine having a side removed to reveal an interior of the wheel assembly.

FIG. 3 is a section view of a wheel assembly 68 and impeller 52. The wheel assembly 68 includes a wheel disk 40. While only one wheel disk 40 is shown in FIG. 3, the assembly 68 may also include a pair of wheel disks, as shown in, for example, FIGS. 4 and 5. The second wheel disk may be positioned opposite to the first wheel disk 40 and may be spaced apart by a plurality of blades 10. The wheel assembly 68 of FIG. 3 further includes spacers 30 that aid in spacing apart the wheel disk 40 from other components of the machine 50. The wheel assembly 68 includes a plurality of blades, each generally indicated at 10. The blades 10, which alternatively may be referred to as vanes, aid in throwing blast media.

The blades 10 shown in FIG. 3 have a semi-curved shape as further discussed below with reference to FIG. 6A. Each blade 10 has a leading edge 11 positioned adjacent to a central hub 75 or central axis of the wheel assembly 68, where blast media is first received by the blade 10. At the opposite end of the blade 10, there is a trailing edge 15, from which the blast media is thrown onto a work piece. Each blade 10 is releasably secured to the wheel disk 40. In one embodiment, the wheel disk 40 includes a groove or slot in the side of the wheel disk 40 into which a portion of the blade 10 slides (as shown, for example, in FIG. 4). In this manner, each blade 10 is fitted to the wheel disk 40. Each blade 10 may include one or two side rails 19 positioned along the length of the blade 10. The side rail 19 is configured to fit within the groove of the wheel disk 40, and secure the position of the blade 10 with respect to the wheel disk 40. Blade widths can vary, generally from 2 inches to 5 inches (50 mm to 112 mm), but other widths outside of this range also fall within the scope of this disclosure. Blade lengths can vary as well, generally from 3 inches to 7 inches (75 mm to 180 mm), but other lengths outside of this range also fall within the scope of this disclosure. Blade length may also be referred to in terms of a complete wheel diameter. Wheel diameters can vary, generally from 10 inches to 26 inches, but other diameters outside of this range also fall within the scope of this disclosure.

Figure 4:
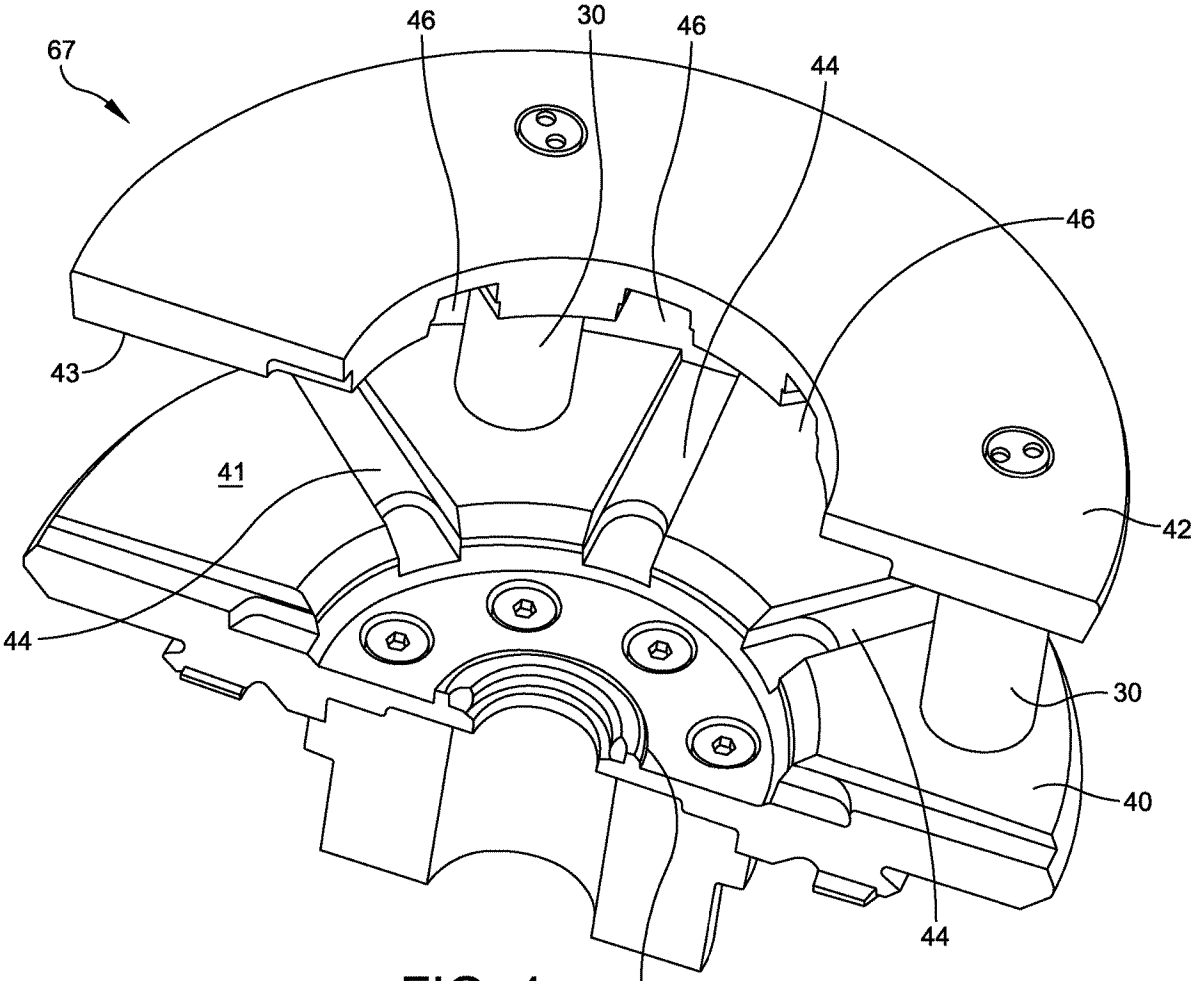
FIG. 4 is a perspective cross-sectional view of a bare wheel assembly with exposed grooves.

FIG. 4 illustrates a bare wheel assembly generally indicated at 67 having wheel disks 40, 42 separated by spacers 30. As shown, the wheel disks 40, 42 have grooves 44, 46, respectively, formed therein, which receive the blades. The bare wheel assembly 67 includes the first wheel disk 40 having a first side 41, in which the first plurality of grooves 44 are defined. Each groove 44 is shaped to receive a blade. The bare wheel assembly 67 includes the second wheel disk 42 spaced apart from the first wheel disk 40 by spacers 30, which are secured to the first and second wheel disks in a suitable manner. The second wheel disk 42 has a second side 43, facing the first side 41 of the first wheel disk 40. The second plurality of grooves 46 are defined in the second side 43 of the second wheel disk 42. The first set of grooves 44 face and are aligned with corresponding grooves 46 from the second set of grooves. When blades are inserted to the bare wheel assembly 67, each blade is received by a corresponding pair of grooves 44, 46, according to this embodiment.

Figure 5:
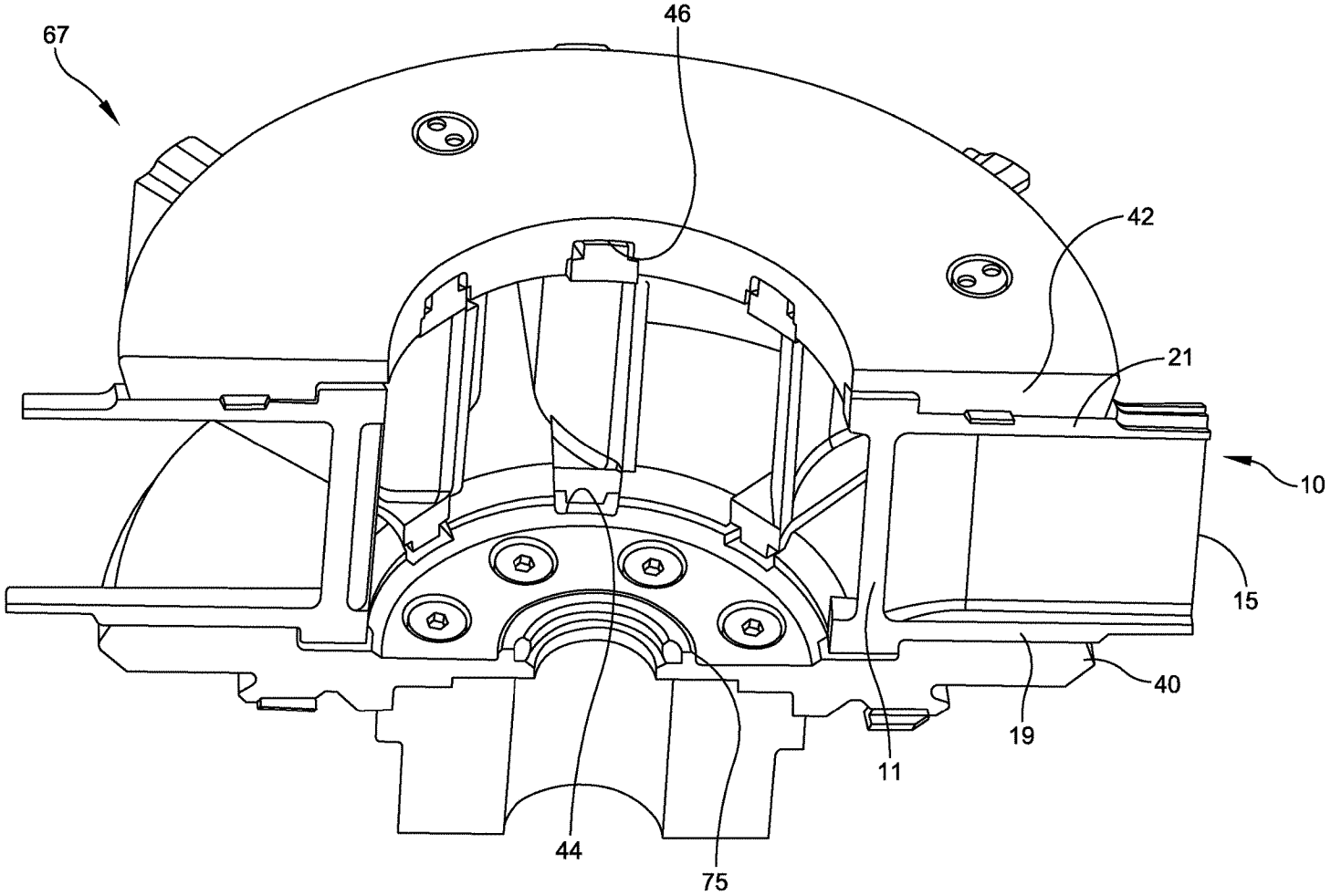
FIG. 5 is a perspective cross-sectional view of a wheel assembly with inserted blades.

FIG. 5 illustrates the wheel assembly 67 having blades 10 inserted in each pair of grooves 44, 46. In FIG. 5, each of the grooves 44 on the first wheel disk 40 receives the blade 10, and in particular, receives a side rail 19 of the blade. Each of the grooves 46 on the second wheel disk 42 receives the blade 10, and in particular, receives a side rail 21 of the blade. In one embodiment, the blades 10 are positioned so that the leading edge 11 is proximate the central hub 75, with the trailing edge 15 extending radially outwardly.

Figure 6A:
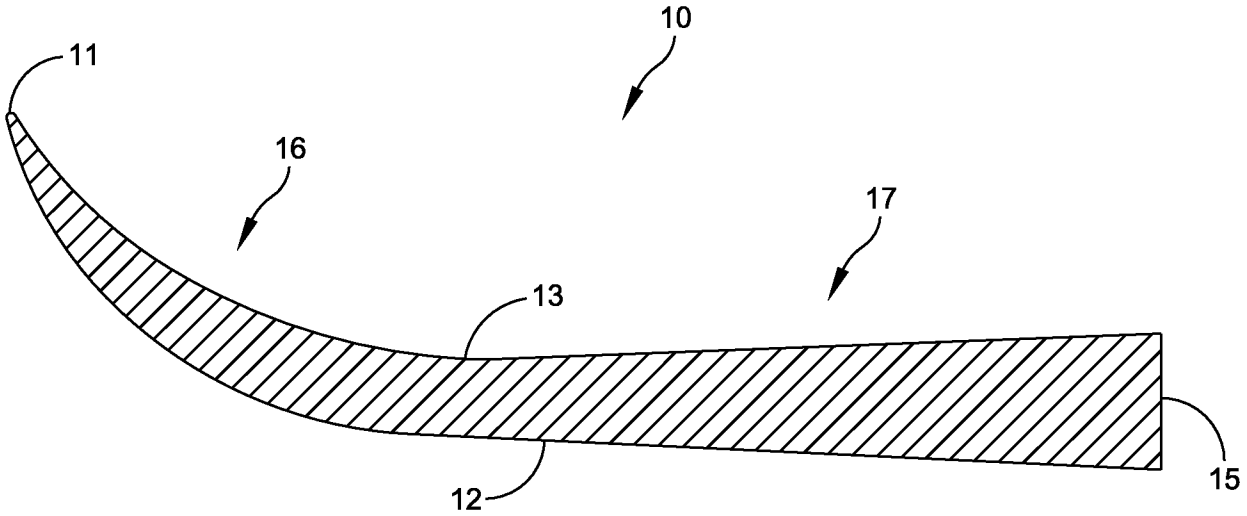
FIG. 6A is a cross-sectional view showing an embodiment of a semi-curved blade.

FIG. 6A illustrates a side view of a blade 10 that is semi-curved. A leading edge 11 is affixed to a wheel disk 40 of a wheel assembly 68. Opposite the leading edge 11 is a trailing edge 15 where the abrasive material exits the blade 10 during operation. Blade 10 has a top surface 13 that faces the direction of the rotation of blade 10 and that receives the abrasive material. Blade 10 has a bottom surface 12 on the face opposite to that of the top surface 13. The blade 10 comprises a curved portion 16 that extends from the leading edge 11. The curved portion 16 ends at straight portion 17 which extends from the trailing edge 15. When attached to a wheel assembly, the curved portion 16 is positioned adjacent a central hub of the wheel assembly, and the straight portion 17 is integrally formed with the curved portion 16 extending radially outwardly from the wheel assembly 68.

Figure 6B:
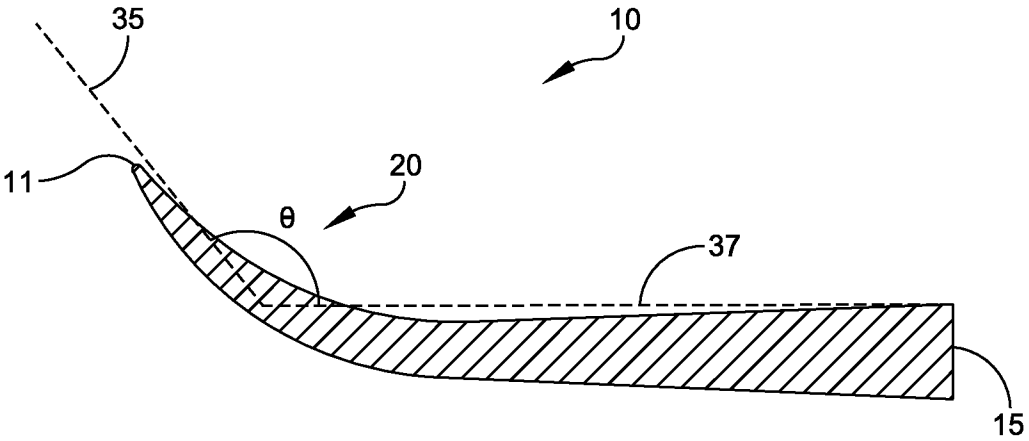
FIG. 6B is a cross-sectional view showing an embodiment of a semi-curved blade.

One measure of the curvature of the blade 10 is indicated by the angle theta 20. The angle theta 20 measures an angle formed between the trailing edge 15 and the leading edge 11. More specifically, as shown in FIG. 6B, the angle theta 20 measures the angle between hypothetical line 37, which corresponds to the orientation of blade at the trailing edge 15, and hypothetical line 35, which is tangent to the surface of the blade at the leading edge 11. For the semi-curved blade 10, the angle formed may be between 105° and 145°. Alternatively the angle formed may be between 120° and 130°.

The blade includes two distinct geometries, a curved portion and a straight portion, each providing certain advantages. Different geometries at different locations within the blade perform specific functions in regards to hot spot, velocities, and abrasive consumption. The blade geometry proximate the leading edge 11 controls the abrasive consumption. The blade geometry proximate the trailing edge 15 controls the velocity of the abrasive.

A semi-curved blade having a curved portion 16 proximate the leading edge 11 and a straight portion 17 proximate the trailing edge 15 achieves a reduced abrasive consumption without decreasing blade life from wear, while increasing abrasive velocities. Such a geometry aids in reducing a significant cost in the operation of a blast wheel—abrasive consumption. In certain embodiments, the curved portion 16 may extend for one half the length of the blade, while the straight portion 17 extends for the other half of the blade.

The disclosed blade design may reduce abrasive consumption without the unintended effects of increased abrasive acceleration or decreased blade life, as compared to conventionally designed blades. This blade design may therefore lead to reduced operating costs resulting from reduced abrasive consumption, without increasing operating costs associated with the expense of replacing blades whose blade life has been decreased.

The initial curved shape in the curved portion 10 extending from the leading edge 11, may allow for a more gentle abrasive transition from the exit of the control cage 58 onto the blade 10, as compared to a traditional straight blade. Traditional straight blades act like a 'battering ram' in which the abrasive hits the blade at great force, and then bounces off the surface several times before properly sliding over the blade surface.

Unlike traditional full curved blades, the semi-curved blade 10 changes from a curved shape to a straight shape to reduce the 'acceleration curve' effect and to minimize the potential of over-accelerating the abrasive and, thus, the forces applied to the abrasive. By reducing the forces applied to the abrasive, consumption of the abrasive may be reduced. Furthermore, by reducing the applied forces, blade life may also be extended, as the result of less wear.

Figure 7:
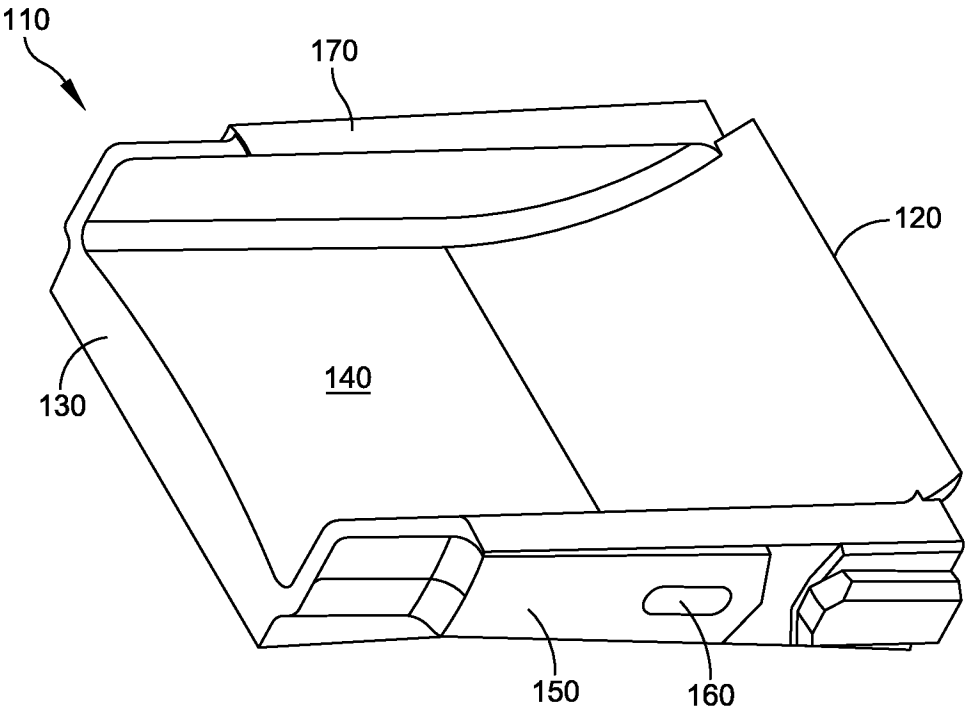
FIG. 7 is a perspective view of an embodiment of a blade.

FIG. 7 illustrates a blade generally indicated at 110 having a grommet positioned along a side rail for forming a compression fit with the wheel disk of the wheel assembly. The blade 110 shows a top surface 140 for receiving blast media. A leading edge 120 and a trailing edge 130 are positioned at the opposite ends of the blade 110. On one side of the blade 110 is a side rail 150. On one side of the blade 110 is a side rail 170. The side rail 150 includes a recess in which a grommet 160 is positioned. The grommet 160 is designed to aid in forming a compression fit between the blade 110 and the wheel disk of the wheel assembly. The grommet 160 may be made of any material suitable for providing sufficient friction to aid in creating a compression fit. For example, the grommet 160 may be a rubber grommet 160. The casted recess of the side rail 150 may be round with no sharp corners with a minimum radius of 5° to prevent stress risers and cracking. The grommet plug 160 is inserted either manually or by automated process into the recess.

While the blade 110 shown in FIG. 7 is a semi-curved blade, the side rail 150 having a grommet 160 could function with any desired blade geometry. Alternative embodiments to that shown in FIG. 7 include a blade 110 having only a single side rail 150 with a grommet 160, as well as a blade 110 having a grommet 160 positioned in the second side rail 170, as well.

Inclusion of a grommet aids in installation and removal of blades into and from a wheel assembly. Methods for maintaining a centrifugal blast wheel machine are disclosed herein. The method includes providing a centrifugal blast wheel machine having a wheel assembly. The wheel assembly includes a wheel disk with a groove, and a first blade. The first blade has a side rail extending along the length of the blade. The side rail has a recess, in which a grommet is positioned. The blade is positioned in the groove of the wheel disk, secured by a compression fit between the grommet and the wheel disk. To install the blade having a grommet in the side rail, the blade is inserted into a groove in the wheel disk of the wheel assembly, where the grommet comes into contact with the wheel disk. From a tapered design, a compression fit is created between the rubber grommet and the wheel disk of the wheel assembly. A plurality of blades may be positioned in the wheel disk in this manner.

When the wheel assembly requires maintenance because, for example, a blade or multiple blades require replacement, the original blade or blades are removed. The blade may be removed by applying a force to the blade sufficient to overcome the compression fit. For example, a simple tap on the blade may be sufficient to free the blade. Once the blade is removed, the grommet can also be removed by use of a simple tool such as pliers or a screw driver. By providing easy removal of the grommet, the grommet and casting can be recycled separately, thus providing an environmentally friendly element to the device.

A different new or refurbished blade is then inserted into the groove. The new blade may include all the features of the first blade, including the grommet positioned in the recess of the side rail. The new blade is secured in the groove by compression fit between the grommet and the wheel disk. In this manner all blades of the wheel disk can be simply and easily replaced when maintenance is required.

Figure 8:
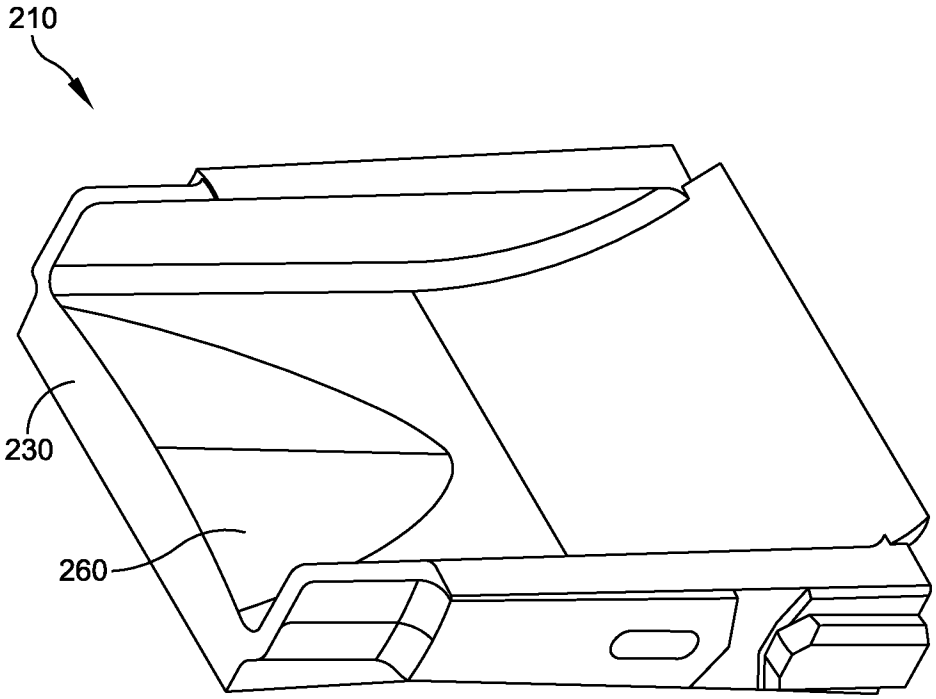
FIG. 8 is a perspective view of an embodiment of a blade.

FIG. 8 illustrates an alternative geometry for the semi-curved blade 210 incorporating a convex tip 260 proximate the trailing edge 230. A more detailed description of the convex tip 260 may be found in U.S. Pat. No. 6,764,390, incorporated by reference herein, in its entirety and for all purposes.

Having thus described several aspects of at least one embodiment of this disclosure, it is to be appreciated various alterations, modifications, and improvements will readily occur to those skilled in the art. Such alterations, modifications, and improvements are intended to be part of this disclosure, and are intended to be within the spirit and scope of the disclosure. Accordingly, the foregoing description and drawings are by way of example only.

What is claimed is:

1. A centrifugal blast wheel machine comprising:
- a housing; and
- a wheel assembly coupled to the housing, the wheel assembly including:
  - a first wheel disk with a first side and a first plurality of grooves in the first side, and
  - a plurality of blades configured to throw blast media introduced into the wheel assembly against a work piece, each blade including
    - a top surface to receive blast media,
    - a curved portion positioned adjacent a central hub of the wheel assembly,
    - a straight portion integrally formed with the curved portion extending radially outwardly from the wheel assembly,
    - a first side rail extending along a first side of the blade, the first side rail having a first recess, and
    - a first grommet positioned in the first recess;
  - wherein each groove is configured to receive a corresponding blade of the plurality of blades, the corresponding blade being secured in place through a compression fit between the first side of the first wheel disk and the first grommet of the corresponding blade.

2. The centrifugal blast wheel machine of claim 1, wherein the first side rail is tapered to aid in creating the compression fit.

3. The centrifugal blast wheel machine of claim 1, wherein the second side rail being opposite the first side rail.

4. The centrifugal blast wheel machine of claim 3, wherein the second side rail comprises a second recess and a second grommet positioned in the second recess.

5. The centrifugal blast wheel machine of claim 4, wherein the wheel assembly further includes a second wheel disk having a second side and a second plurality of grooves in the second side, the second side of the second wheel disk being spaced apart from the first side of the first wheel disk.

6. The centrifugal blast wheel machine of claim 5, wherein each groove of the first plurality of grooves and each groove of the second plurality of grooves are configured to receive a corresponding blade from the plurality of blades, the corresponding blade being secured in place through compression fit between the first side of the first wheel disk and the first grommet of the corresponding blade and between the second side of the second wheel disk and the second grommet of the corresponding blade.

7. The centrifugal blast wheel machine of claim 6, wherein each of the first side rail and the second side rail is tapered to aid in forming the compression fit.

8. The centrifugal blast wheel machine of claim 1, wherein the first grommet and the first recess are configured to allow removal of the first grommet from the first recess at an end of a service life of the blade.

9. The centrifugal blast wheel machine of claim 1, wherein each of the first grommet and the first recess is rounded.

10. The centrifugal blast wheel machine of claim 1, wherein each blade of the plurality of blades has a first edge proximate the curved portion, and a second edge proximate the straight portion.

11. The centrifugal blast wheel machine of claim 10, wherein the curved portion extends approximately one half a length of each blade.

12. A method of maintaining a centrifugal blast wheel machine comprising:
- providing a centrifugal blast wheel machine having a wheel assembly, the wheel assembly including
  - a wheel disk with a groove, and
  - a first blade having
    - a top surface to receive blast media,
    - a curved portion positioned adjacent a central hub of the wheel assembly,
    - a straight portion integrally formed with the curved portion extending radially outwardly from the wheel assembly,
    - a first side rail extending along a first side of the first blade, the first side rail having a first recess, and a first grommet positioned in the first recess, the first blade being secured in the groove by a compression fit between the first grommet and the wheel disk;

removing the first blade from the wheel disk;

inserting a second blade into the groove of the wheel disk, the second blade being identical in construction to the first blade; and securing the second blade in the groove by compression fit between a first grommet of the second blade and the wheel disk.

13. The method of claim 12, wherein removing the first blade from the wheel disk comprises applying a force to the first blade sufficient to overcome the compression fit between the first grommet and the wheel disk.

14. The method of claim 12, further comprising removing the first grommet from the first blade after removing the first blade from the wheel disk.

* * * * *